US007097508B1

(12) United States Patent
Yang

(10) Patent No.: US 7,097,508 B1
(45) Date of Patent: Aug. 29, 2006

(54) COMPACT FLUORESCENT LAMPHOLDER

(75) Inventor: Wen-Ho Yang, Taipei (TW)

(73) Assignee: Sun-Lite Sockets Industry Inc., Taoyuan (TW)

( * ) Notice: Subject to any disclaimer, the term of this patent is extended or adjusted under 35 U.S.C. 154(b) by 0 days.

(21) Appl. No.: 11/222,747

(22) Filed: Sep. 12, 2005

(51) Int. Cl.
*H01K 1/00* (2006.01)

(52) U.S. Cl. ..... 439/617; 439/232

(58) Field of Classification Search ..... 439/220, 439/232, 617, 615, 613, 236, 336, 646
See application file for complete search history.

(56) References Cited

U.S. PATENT DOCUMENTS 5,286,216 A * 2/1994 Volz ..... 439/236
5,634,820 A * 6/1997 Vakil ..... 439/646
6,582,269 B1 * 6/2003 Sakai et al. ..... 445/26
7,033,220 B1 * 4/2006 Yang ..... 439/617

* cited by examiner

*Primary Examiner*—Hae Moon Hyeon
(74) *Attorney, Agent, or Firm*—Bacon & Thomas

(57) ABSTRACT

A compact fluorescent lampholder includes a fundamental base and a holder body combined together. The fundamental base is provided with a female thread post inside. Electric current is transmitted to two conducting members beside the female threaded post. The holder body is fixed with a center male-threaded post on the topside to be combined with the female threaded post and two conducting posts beside the center threaded post. The conducting posts contacts with the conducting members for receiving electric current after the center male-threaded post is combined with the female threaded post. The conducting posts transmits electric current to a circuit board in the socket body and then to the conducting posts of a CFL under the holder body for starting the CFL to give out light. The holder body and the fundamental base can be separated for facilitating installing of CFLs.

5 Claims, 10 Drawing Sheets

(A-A)

(B-B)

(C-C)

COMPACT FLUORESCENT LAMPHOLDER

BACKGROUND OF THE INVENTION

1. Field of the Invention

This invention relates to a compact fluorescent lampholder (CFLH in short), particularly to one including a holder body for a compact fluorescent lamp (CFL) to be assembled thereon and a fundamental base for connecting an electric source. The holder body and the fundamental base can be threadably combined together for making electric connection and turned reversely to be separated from each other. Therefore, when the holder body is separated from the fundamental base, a CFL can be conveniently installed on the holder body and then they are threadably combined together again, quite convenient in carrying out installing work of a CFL.

2. Description of the Prior Art

Generally, a conventional CFLH includes a holder body fixedly assembled at a certain location, such as a decorated ceiling or the like. To install a CFL on the holder body, a user has to hold the pin lamp and have its pins aligned to the insert holes of the holder body and then carefully inserted them therein. The conventional CFLH is mostly fixed firmly at comparatively high locations; therefore, when a CFL is to be installed or replaced, a user always cannot do without a chair or a ladder and has to raise both his hands, with one hand holding the wall for preventing tumbling down and the other hand holding the CFL and installing it on the holder body. Since the conventional CFLH is designed with an inseparable structure, after the CFLH is fixed in position, it is impossible to take parts off its structure or lower its position, thus increasing difficulty in installing a CFL on the CFLH because the CFL must be adjusted to the height and the position of the insert holes of the holder body.

SUMMARY OF THE INVENTION

The objective of the invention is to offer a CFLH possible to let its parts separated for facilitating installing of CFLs, needless to stand at a high location for carrying out installing work of CFLs.

The CFLH in the present invention is composed of a fundamental base and a holder body. The fundamental base has its underside provided in the center with a female threaded post and two conducting members at the opposite sides of the female threaded post for receiving electric current. The holder body is fixed on the topside with a center threaded post with male threads to be threadably combined with the female threaded post of the fundamental base and has two conducting posts positioned at the opposite sides of the center threaded post. When the center threaded post of the holder body is threadably combined with the female thread post of the fundamental base, the two conducting posts of the holder body are respectively in contact with the two conducting members of the fundamental base to transmit the electric current to the circuit board installed in the interior of the holder body. Then, the electric current is transmitted to the conducting posts of a pin lamp assembled under the holder body for starting the pin lamp to give out fluorescent light. When the center threaded post of the holder body is turned reversely and disengaged from the female threaded post of the fundamental base, the holder body and the fundamental base can be separated from each other, and electric current between the conducting posts of the holder body and the conducting members of the fundamental base will be interrupted immediately.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
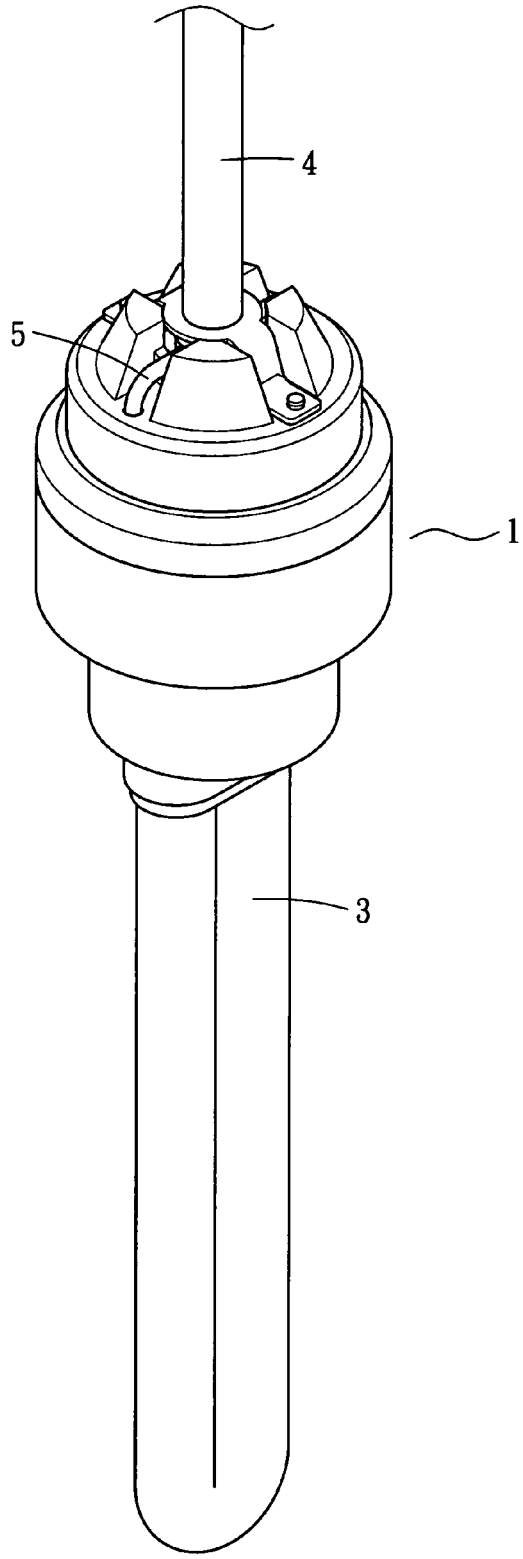
FIG. 1 is a perspective view of a CFLH in a using condition in the present invention.
Figure 2:
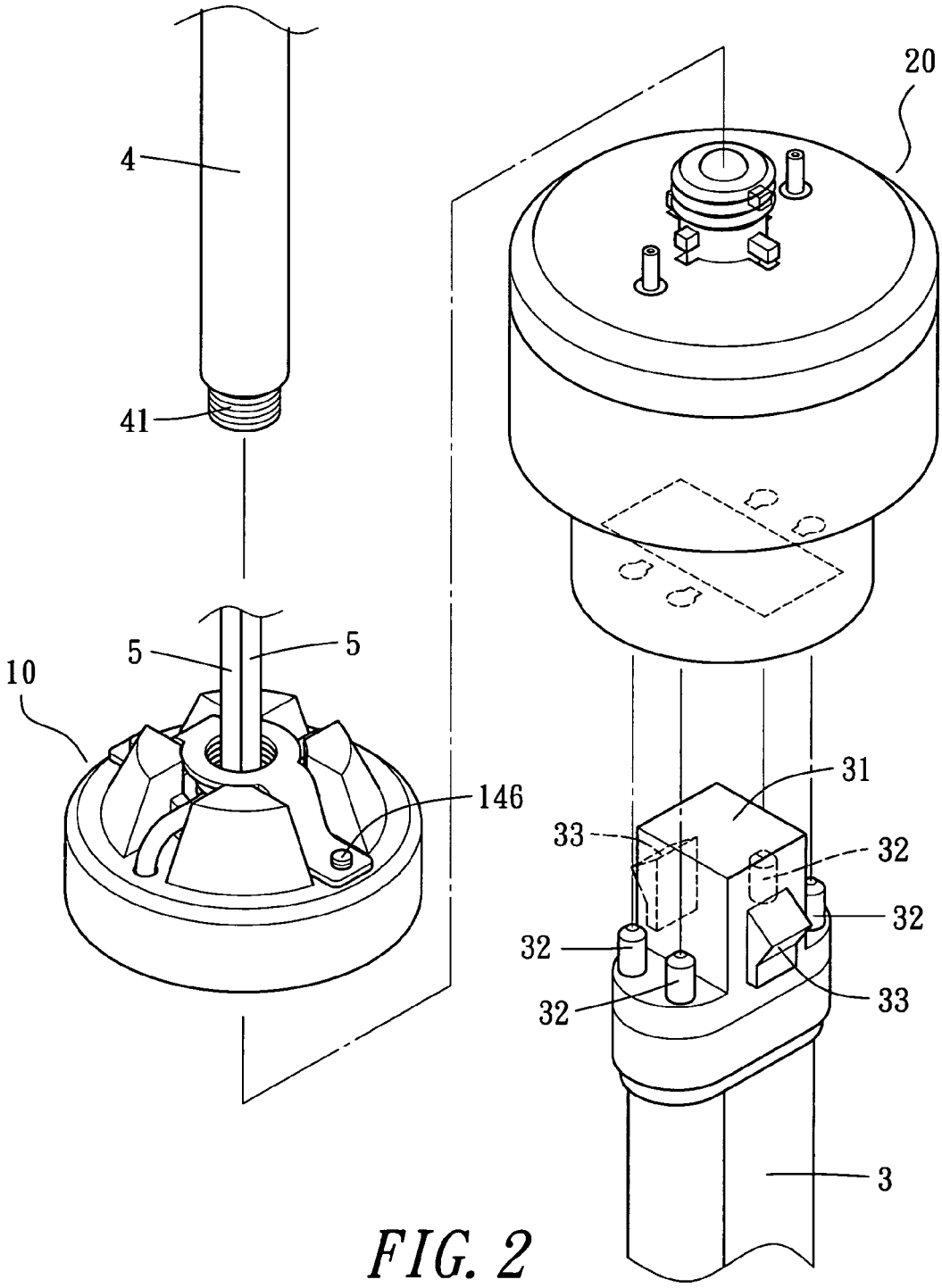
FIG. 2 is an exploded perspective view of the CFLH in the present invention.

A preferred embodiment of a CFLH 1 in the present invention, as shown in FIGS. 1 and 2, includes a rigid or a flexible wire tube assembled on the topside of the CFLH 1, a fundamental base 10 and a holder body 20 able to be threadably combined with the fundamental base 10 or turned reversely and separated from it.

Figure 3:
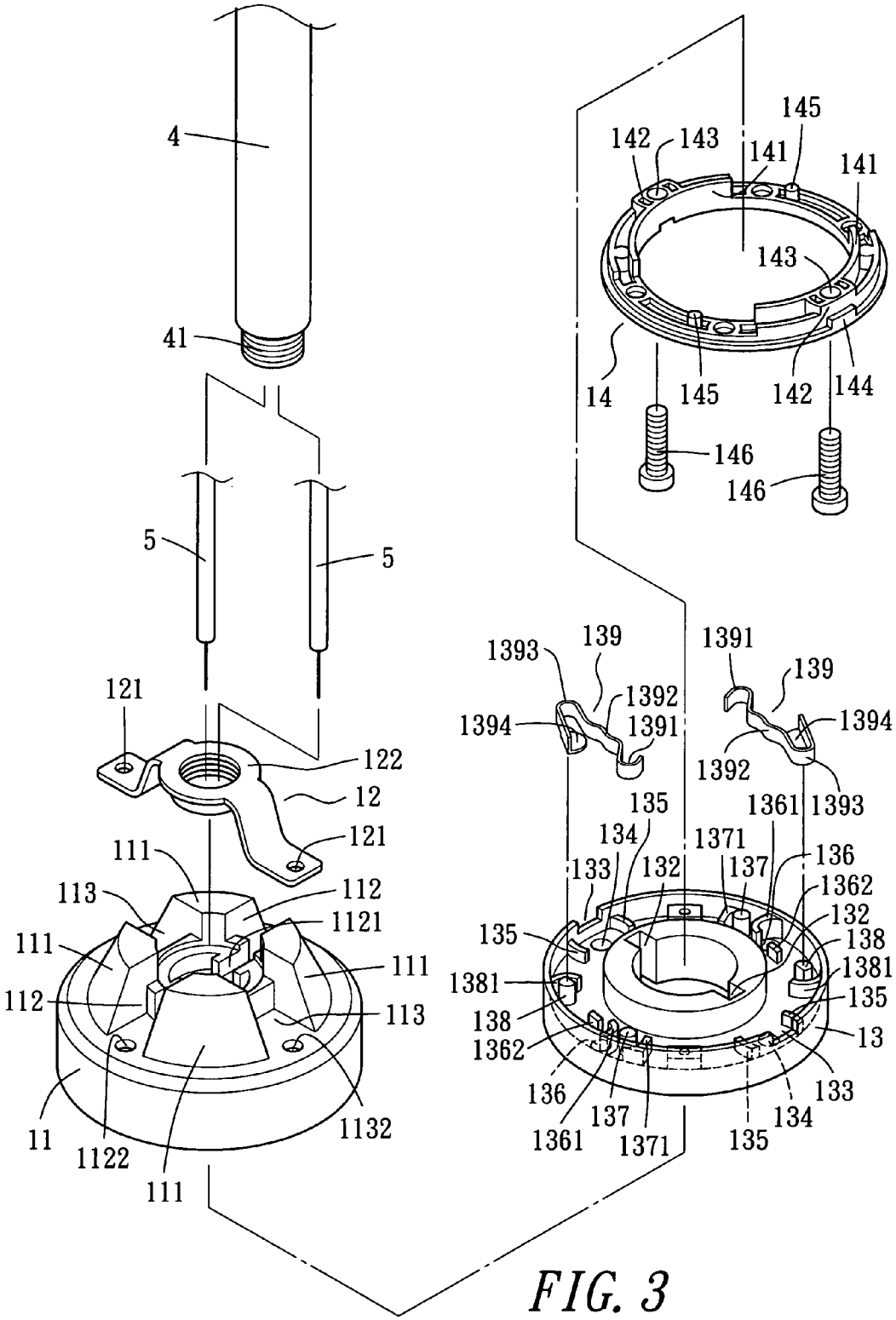
FIG. 3 is an exploded perspective view of a fundamental base, a combining member, a wire tube and electrical wires in the present invention.
Figure 4:
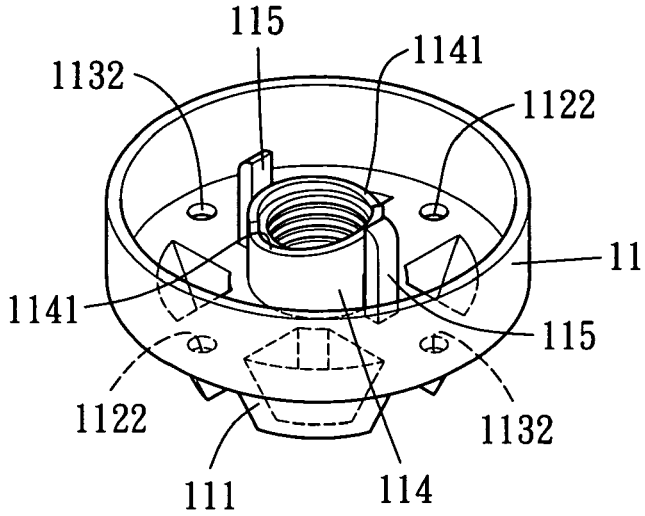
FIG. 4 is a bottom perspective view of the fundamental base in the present invention.

The fundamental base 10, as shown in FIG. 3, is composed of a base body 11, a combining member 12, an inner cover 13 and a bottom cover 14. The base body 11 has its topside formed with four lofty blocks 111 spaced apart equidistantly and defining two cross horizontal grooves 112, 113 therebetween. The horizontal groove 112 has its lower edge cut with a clamping notch 1121, and the horizontal groove 112, 113 have their opposite ends respectively bored with an insert hole 1122, 1132. The base body 11, referring to FIG. 4 showing that the base body 11 is inverted, has its bottom side formed with an inner recessed space with the insert holes 1122, 1132. The inner recessed space has a central female threaded post 114 extending downward and having its lower edge formed with two symmetrical slanting walls 1141 and its outer circumferential edge formed with two symmetrical projecting posts 115, with an inner recessed groove (not numbered) formed in the underside of each lofty block 111, as shown in FIG. 4.

The combining member 12, as shown in FIG. 3, is shaped as an elongate plate having its opposite ends positioned lower than its central portion and respectively bored with a threaded hole 121. The lofty center portion of the combining member 12 is formed with a female threaded ring 122. After the opposite ends of the combining member 12 are stuffed in to the horizontal groove 113 and the two threaded holes 121 are respectively aligned to the two insert holes 1132 of the base body 11, the female threaded ring 122 of the combining member 12 is exactly positioned in the space defined by the four lofty blocks 111 and also located above the clamping notch 1121 of the base body 11. The wire tube 4 has its lower end formed with a threaded stud 41 to be threadably combined with the female threaded hole of the female threaded ring 122 of the combining member 12, as shown in FIG. 1. Before the wire tube 4 is combined with the female thread ring 122, two electrical wires 5 are drawn out of the lower end of the wire tube 4 and inserted through the center of the female thread ring 122. Afterward, the two electrical wires 5 are separately engaged in the clamping notch 1121 and then respectively inserted through the two insert holes 1122 of the base body 11. After the combining member 12 has its opposite ends stuffed into the horizontal groove 113 and its opposite threaded holes 121 respectively aligned to the two insert holes 1132 of the base body 11, the combining member 12 can be firmly assembled on the base body 11 by means of two bolts 146 inserted from under to pass through the bottom cover 14, the inner cover 13 and the insert holes 1132 of the base body 11 and then screwed with the threaded holes 121 of the combining member 12, as shown in FIGS. 1 and 2. After that, the wire tube 4 is threadably combined with the female threaded ring 122 of the combining member 12.

Figure 5:
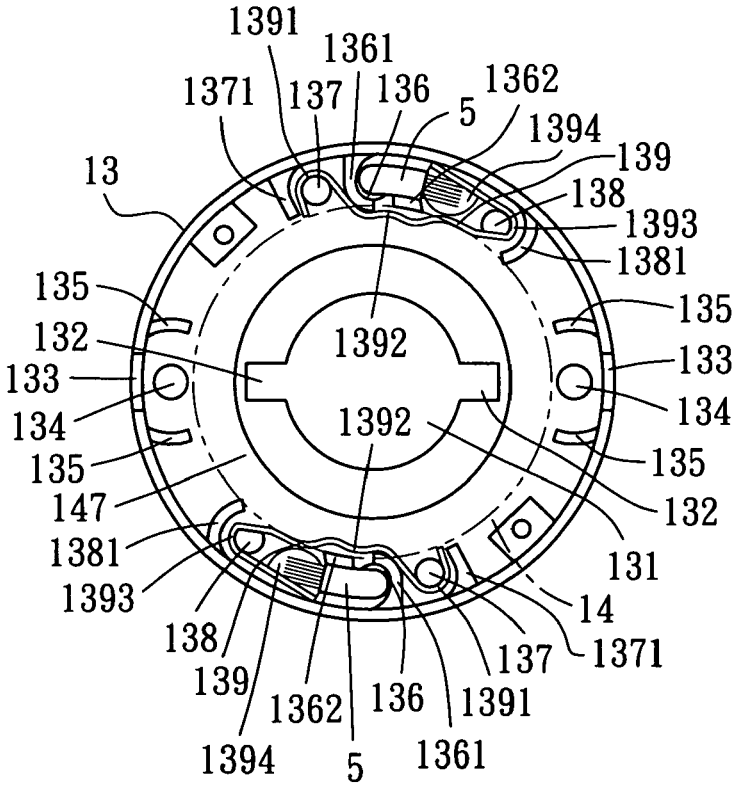
FIG. 5 is a bottom view of an inner cover in the present invention.

The inner cover 13 is to be fitted in the lower inner recessed space of the base body 11, as shown in FIG. 3 (an upper perspective view of the inner cover 13) and FIG. 5 (a bottom view of the inner cover 13). The inner cover 13 has its central portion bored with an insert hole 131 having its circumferential edge cut with two symmetrical postholes 132. The female threaded post 114 at the underside of the base body 11 is inserted through the center insert hole 131 of the inner cover 13, and the two projecting posts 115 at the underside of the base body 11 are respectively inserted in the two post holes 132 of the inner cover 13 for positioning the inner cover 13 under the base body 11, with the ends of the two projecting posts 115 respectively extending out of the post holes 132. The inner cover 13 has the lower outer circumferential edge cut with two symmetrical positioning notches 133, and between the outer edges of the post holes 132 and the inner edges of the positioning notches 133 is formed an annular accommodating space having two insert holes 134 respectively bored at the inner side of the positioning notch 133. During being assembled, the two insert holes 134 of the inner cover 13 are respectively aligned to the two insert holes 1132 of the base body 11, that is, the two positioning notches 133, the two insert holes 134 and the two post holes 132 of the inner cover 13 are respectively in alignment with one another.

In addition, two stop blocks 135 are respectively fixed at the opposite sides of each insert hole 134 of the inner cover 13, and another two insert holes 136 are respectively bored at a right-angled location distant from the insert hole 134. In assembling, the two insert holes 136 of the inner cover 13 are respectively aligned to the two insert holes 1122 of the base body 11; therefore, the ends of the two electrical wires 5 inserted through the insert holes 1122 are pulled downward and inserted in the insert holes 136. Further, an arc-shaped wall 1361 is provided at a location abutting one side of each insert hole 136, and a positioning projection 137 and a protecting wall 1371 are orderly fixed at the locations adjacent to each arc-shaped wall 1361. Furthermore, a lateral protecting wall 1362 is secured at a location abutting the other side of each insert hole 136, and another positioning projection 138 and another protecting wall 1381 are orderly disposed at the location comparatively far from each insert hole 136.

Moreover, two conducting members 139 are elongate plates bent in shape and respectively composed of a first hook end 1391, a waveform conducting portion 1392, a second hook 1393 end bent outward and a combining plate 1394 extending out from the second hook end 1393. In assembling, the two electrical wires 5 respectively inserted through the insert holes 136 of the inner cover 13 have their ends respectively bent and then firmly combined with the combining plates 1394 of the conducting members 139 (preferably by soldering) so that electric current can be transmitted to the conducting members 139. Subsequently, the conducting members 139 are positioned in the inner cover 13, and have their first hook ends 1391 respectively hooking the positioning projection 137 of the inner cover 13 and held by the protecting walls 1371 and their second hook ends 1393 respectively hooking the other positioning projections 138 and held by the other protecting walls 1381. After being assembled, the bent ends of the two electrical wires 5 can be respectively held in position by the two lateral protecting walls 1362, with a minute distance formed between the waveform conducting portions 1392 of the conducting member 139 and the outer circumferential edge of the central insert hole 131 of the inner cover 13, as shown in FIG. 5.

The bottom cover 14 is ring-shaped, as shown in FIG. 3, and has its inner circumferential edge formed with two symmetrical inner arc-shaped walls 141 having their outer portions respectively connected with a position projecting block 142 having an insert hole 143 bored in the center and a positioning member 144 fixed on the outer edge. The bottom cover 14 is further formed with two symmetrical resisting projections 145 and provided with two bolts 146. The bottom cover 14 is to be fitted in the recessed accommodating space in the underside of the inner cover 13 (the dotted line in FIG. 5 indicating the inner edge of the bottom cover 14), letting the two position projecting blocks 142 respectively received in the space formed between the two stop blocks 135 at the underside of the inner cover 13. After the two insert holes 143 of the bottom cover 14 are respectively aligned to the two insert holes 134 at the underside of the inner cover 13, and the two positioning members 144 are respectively positioned in the two positioning notches 133 of the inner cover 13, the two bolts 146 are respectively inserted from under the bottom cover 14 to pass through the insert holes 143 of the bottom cover 14 and the insert holes 134 of the inner cover 13 as well as the insert holes 1132 of the base body 11 and then screwed with the threaded holes 121 of the combining member 12 to combine the bottom cover 14 together with the inner cover 13. After the bottom cover 14 is combined with the inner cover 13, the two resisting projections 145 of the bottom cover 14 will be respectively positioned on the combining plates 1394 of the conducting members 139 for tightly holding the ends of the electric wires 5, which are then combined with the combining plates 1394, with the both prevented from being disconnected. Simultaneously, the two inner arc-shaped walls 141 of the bottom cover 14 will be respectively positioned in a space between one protecting wall 1371 and another opposite protecting wall 1381, and the waveform conducting portions 1392 of the two conducting members 139 will slightly protrude out of the inner edge of the bottom cover 14, with the dotted line in FIG. 5 indicating the inner edge of the bottom cover 14.

After the base body 11, the combining member 12, the inner cover 13 and the bottom cover 14 are orderly combined together to make up the fundamental base 10, the inner cover 13 and the bottom cover 14 are positioned in the interior of the base body 11 so they are invisible, as shown in FIG. 2, and the two conducting members 139 can be electrically connected through the two electric wires 5. Viewed from under the fundamental base 10, only the protruding parts of the two waveform conducting portions 1392 of the two conducting members 139 can be seen, while the other components are covered by the bottom cover 14. An annular passageway 147 is formed between the inner edge of the bottom cover 14, as shown by the dotted line in FIG. 5, and outer circumferential edge of the center insert hole 131 of the inner cover 13 can also be seen, as shown in FIG. 5.

Figure 6:
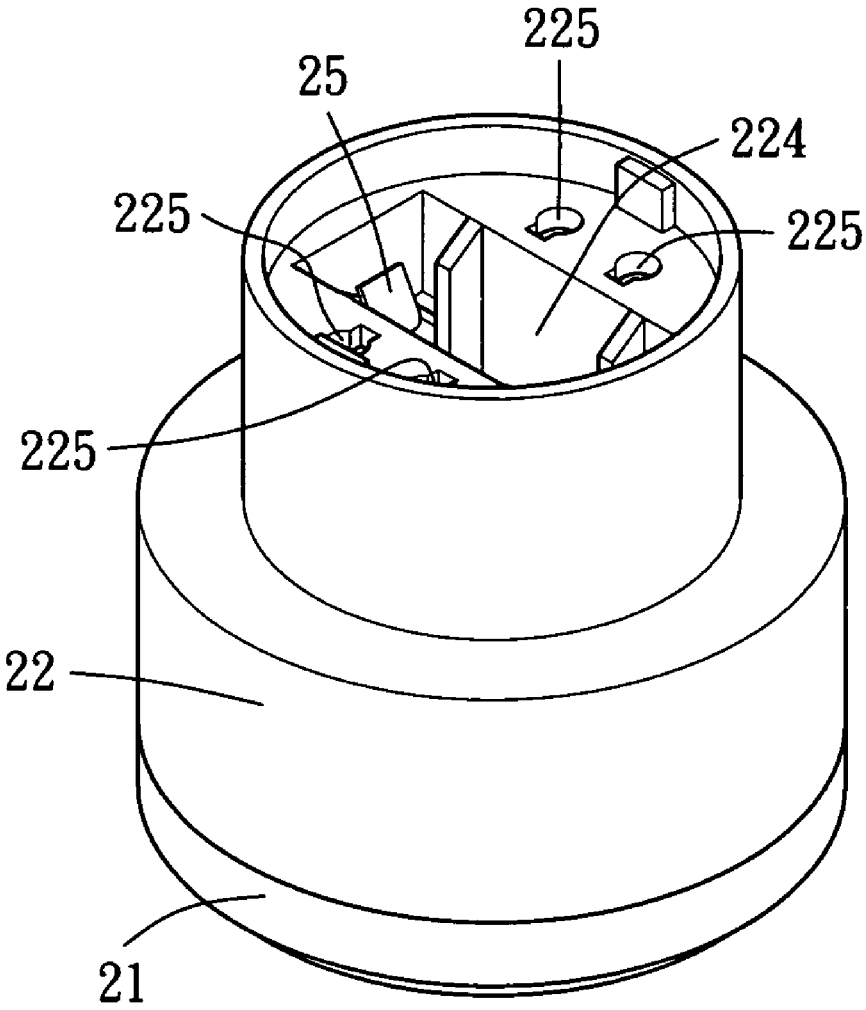
FIG. 6 is a bottom perspective view of a holder body in the present invention.
Figure 7:
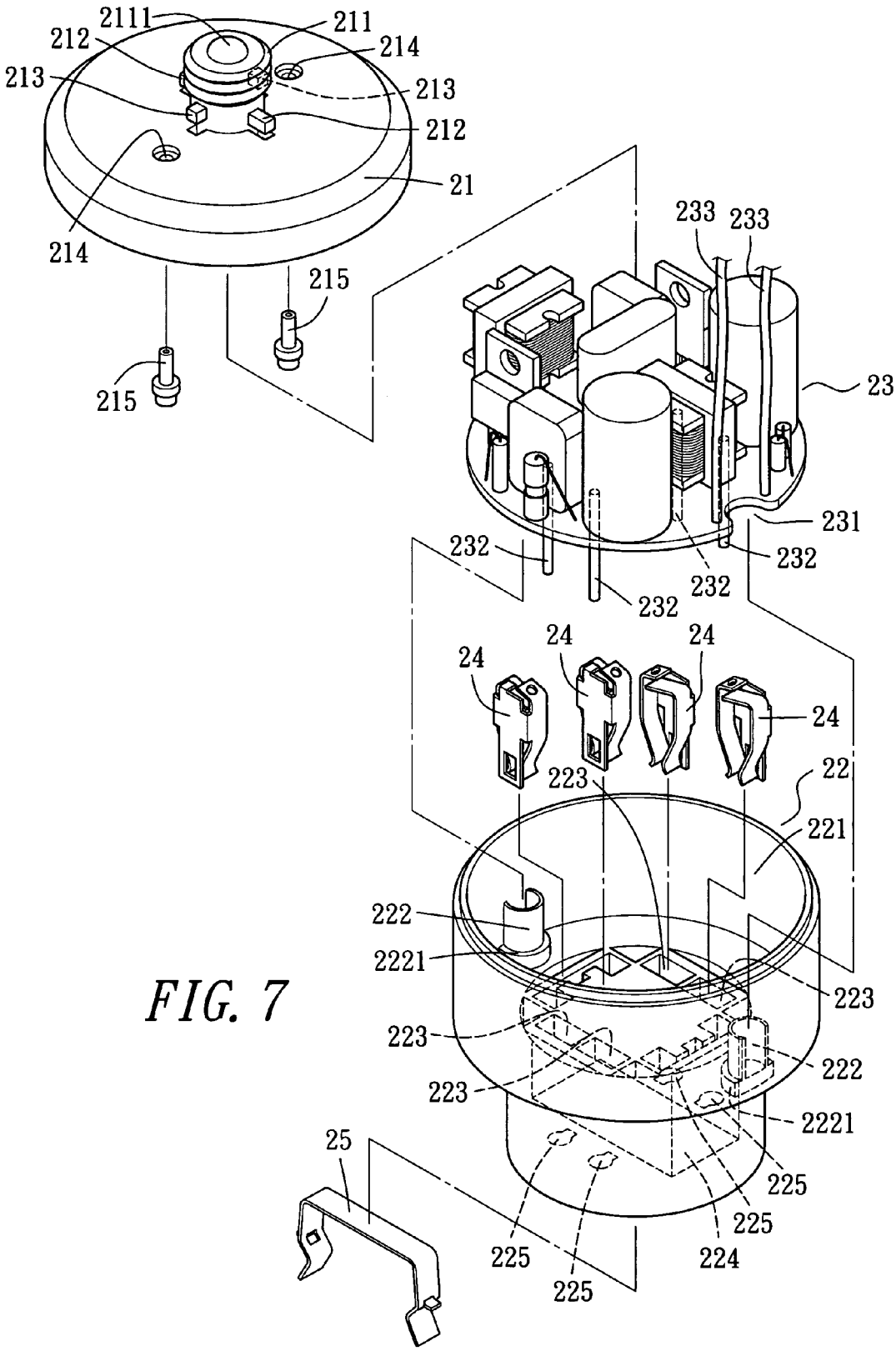
FIG. 7 is an exploded perspective view of the holder body in the present invention.

The holder body 20, as shown in FIGS. 2, 6 and 7, is composed of an upper cover 21, a main body 22, a circuit board 23, plural clamping members 24 and a lamp clamp 25.

The upper cover 21 has its topside fixed with a center male-threaded post 211 extending upward and having its upper end formed with a semi-spherical projection 2111. The center male-threaded post 211 has its lower outer circumferential edge provided with two symmetrical positioning projections 212 and two symmetrical resisting projections 213. The two positioning projections 212 are positioned lower but longer than the two resisting projections 213, and the extension straight line of the two positioning projections 212 and the extension straight line of the two resisting projections 213 intersect at right angles. Further, the upper cover 21 has two insert holes 214 respectively bored at a location near the extension straight line of the two resisting projections 213 for a conducting post 215 to be inserted and riveted therein, with the upper end of the two conducting posts 215 extending out of the upper cover 21, as shown in FIG. 2.

Figure 8:
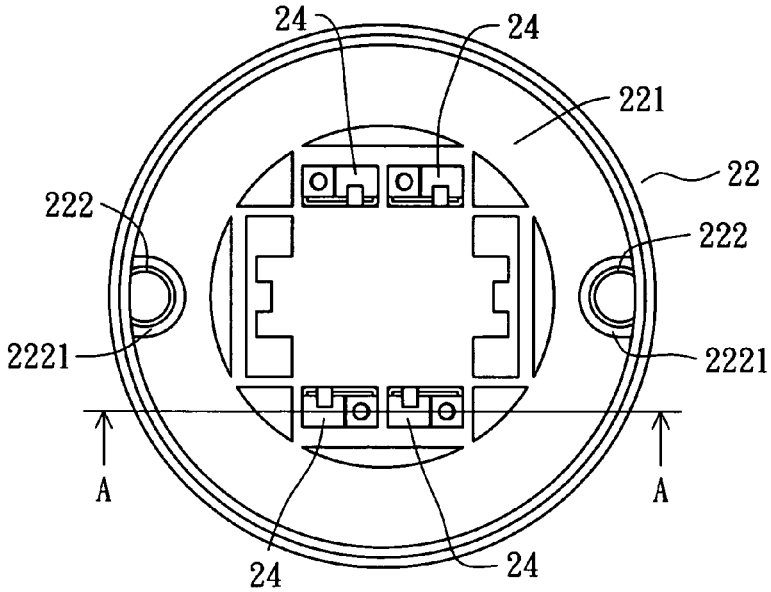
FIG. 8 is an upper view of the holder body in the present invention.
Figure 9:
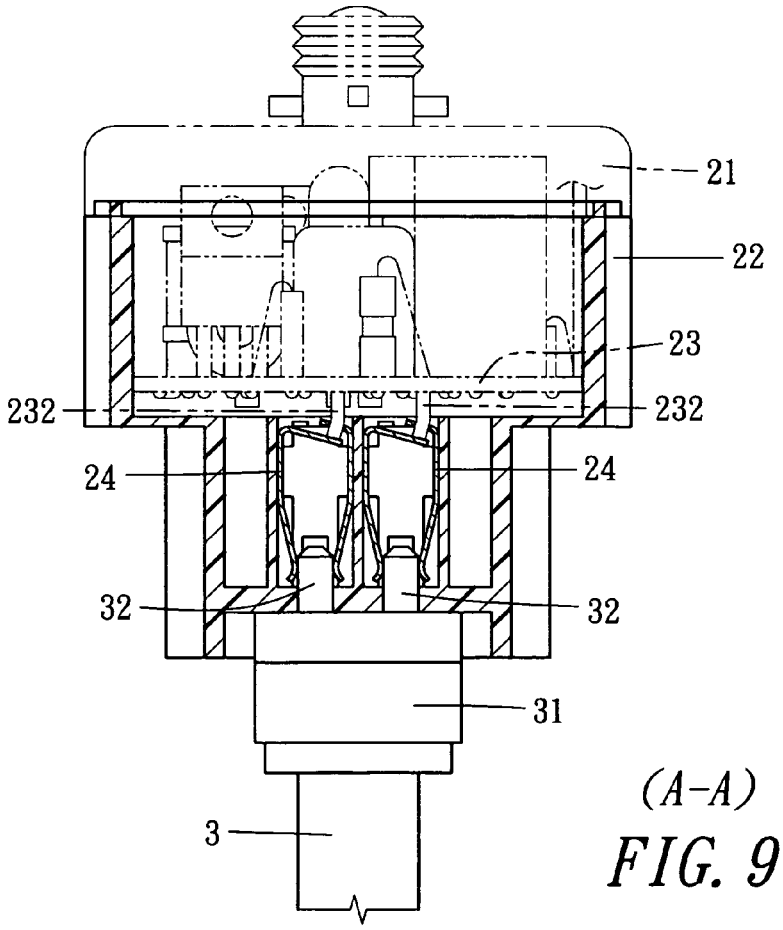
FIG. 9 is a cross-sectional view of the line A—A in FIG. 8.
Figure 10:
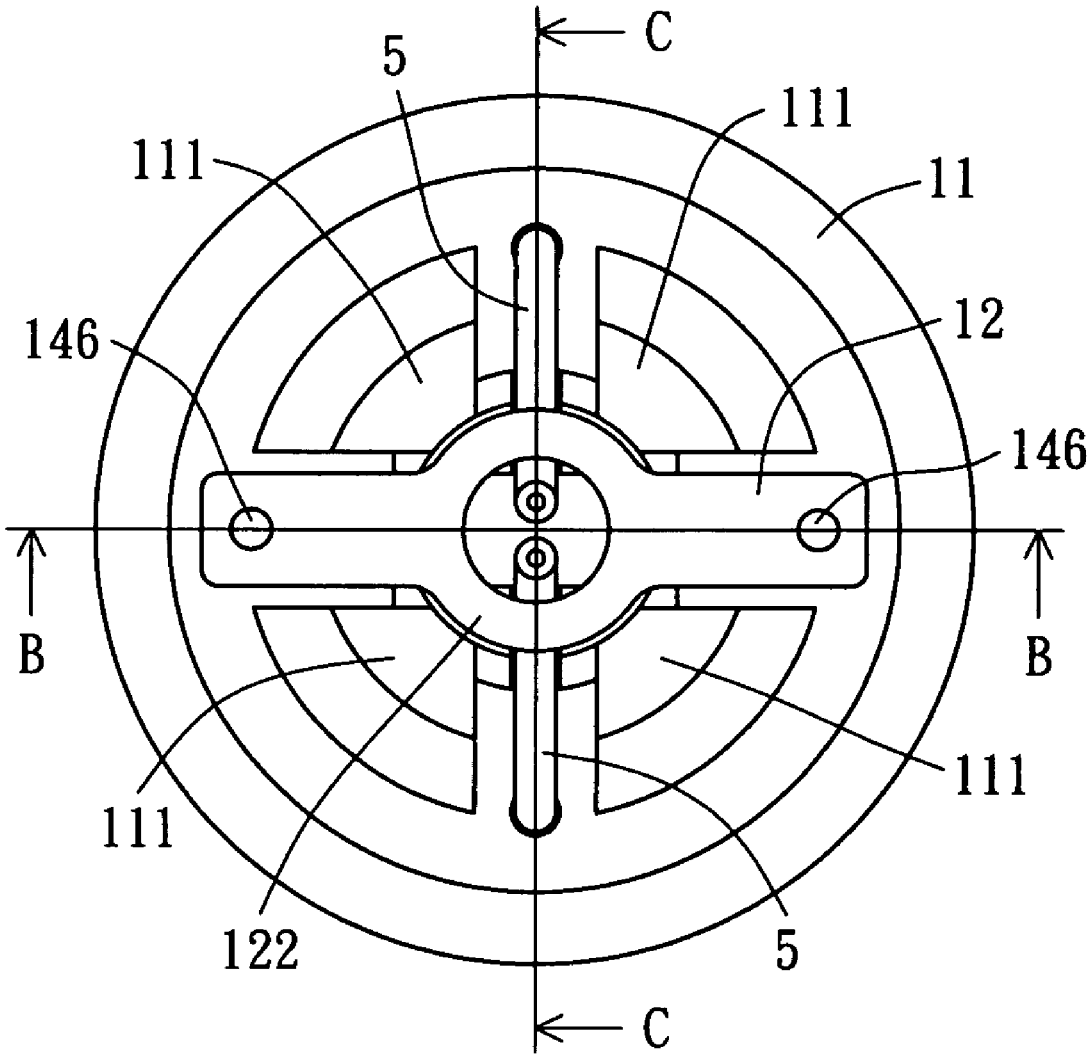
FIG. 10 is an upper view of the CFLH in the present invention.

The main body 22 as shown in FIGS. 7, 8 and 9, has its upper portion formed with a hollow cavity 221 extending downward and having its inner opposite sides respectively provided with a positioning post 222 having its bottom fixed with a positioning block 2221. The hollow cavity 221 has its lower side formed with four holes 223 respectively for receiving the clamping member 24 therein.

The circuit board 23 is a printed circuit board having a plurality of electronic elements inserted thereon for transforming, filtering and rectifying electric current guided therein in order to tally with the starting condition required by a CFL 3. The circuit board 23 is cut with two engage notches 231 respectively at its opposite sides, and provided with four supporting pins 232 extending downward and two electric wires 233 extending upward. When the circuit board 23 is fitted in the hollow cavity 221 of the main body 22, its two engage notches 231 are respectively aligned to and moved downward along the two positioning projections 222 of the main body 22 until they are stopped by the positioning block 2221. Simultaneously, the four supporting pins 232 of the circuit board 23 are respectively inserted in the upper clamping holes of the four clamping members 24 and firmly clamped therein, as shown in FIG. 9. Then, the two electric wires 233 are respectively connected (preferably by soldering) with the lower ends of the two conducting posts 215 of the upper cover 21. Thus, when the conducting posts 215 of the upper cover 21 are electrified, electric current will be immediately transmitted to the circuit board 23 and then continuously transmitted to the four clamping members 24 through the electronic elements. Subsequently, the lower circumferential edge of the upper cover 21 and the upper circumferential edge of the main body 22 are firmly combined together by supersonic welding.

The clamping members 24 have their lower ends respectively formed with clamping lugs. The main body 22, as shown in FIG. 6 (a bottom perspective view), further has the center portion of its bottom formed with an insert groove 224, and its opposite lower sides respectively bored with two small insert holes 225. The lower ends of the four clamping members 24 are located in the interiors of the four small insert holes 225, while a lamp clamp 25 is received in the center insert groove 224. The CFL 3 has a base 31 fixed thereon with four conducting posts 32 to be respectively inserted in the four small insert holes 224 of the main body 22 and also provided thereon with two symmetrical engage blocks 33. Thus, when the base 31 of the CFL 3 is fitted in the center insert groove 224 of the main body 22, the two engage blocks 33 can exactly be camped by the opposite ends of the lamp clamp 25, and after the four conducting posts 32 on the base 31 of the CFL 3 are respectively inserted in the four small insert holes 225 of the main body 22, they are also respectively inserted in the lower ends of the four clamping members 24 and sandwiched therebetween. Therefore, electric current can be transmitted to the four conducting posts 32 through the four clamping members 24 for starting the CFL to give out fluorescent light.

Figure 11:
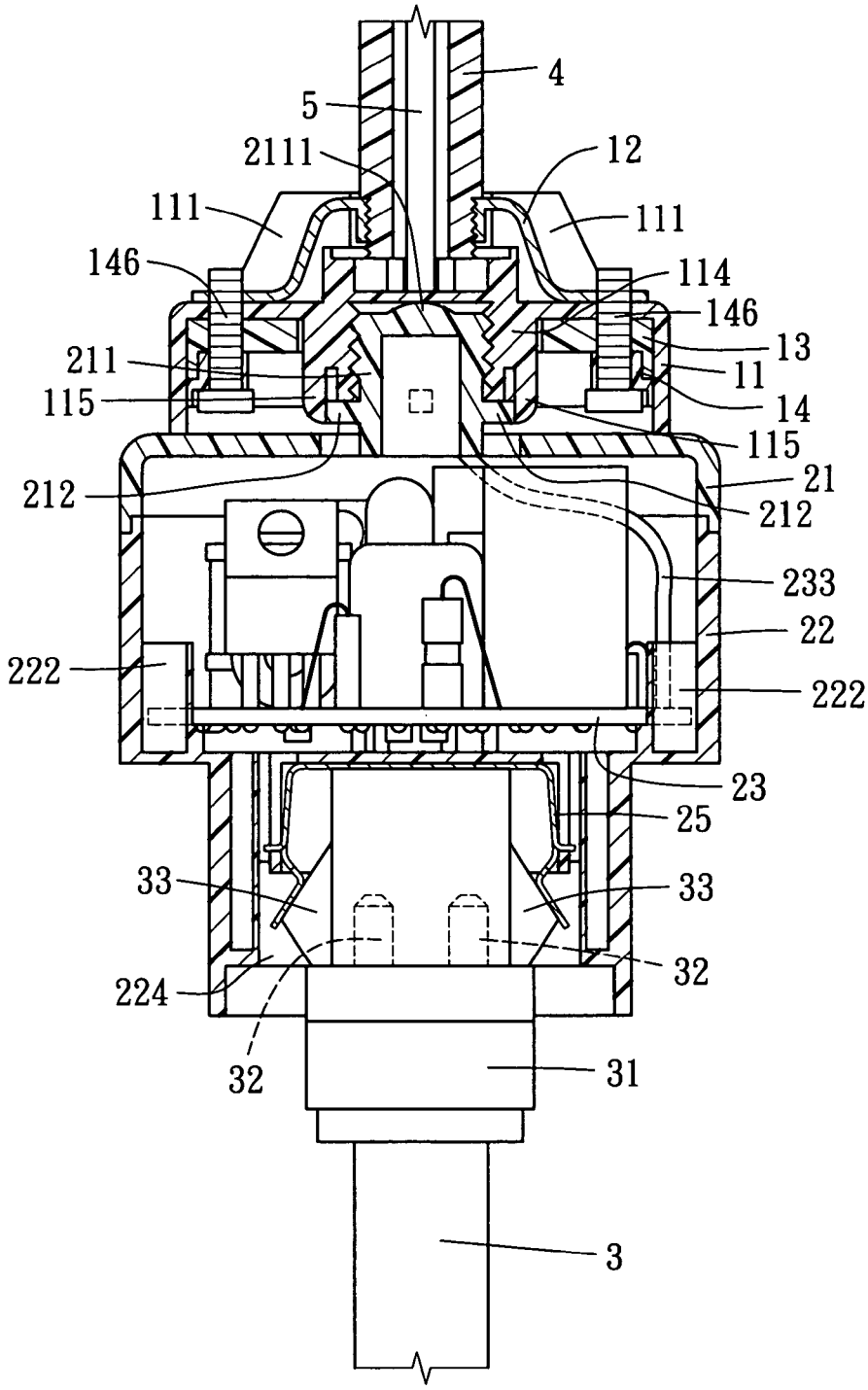
FIG. 11 is a cross-sectional view of the line B—B in FIG. 10.
Figure 12:
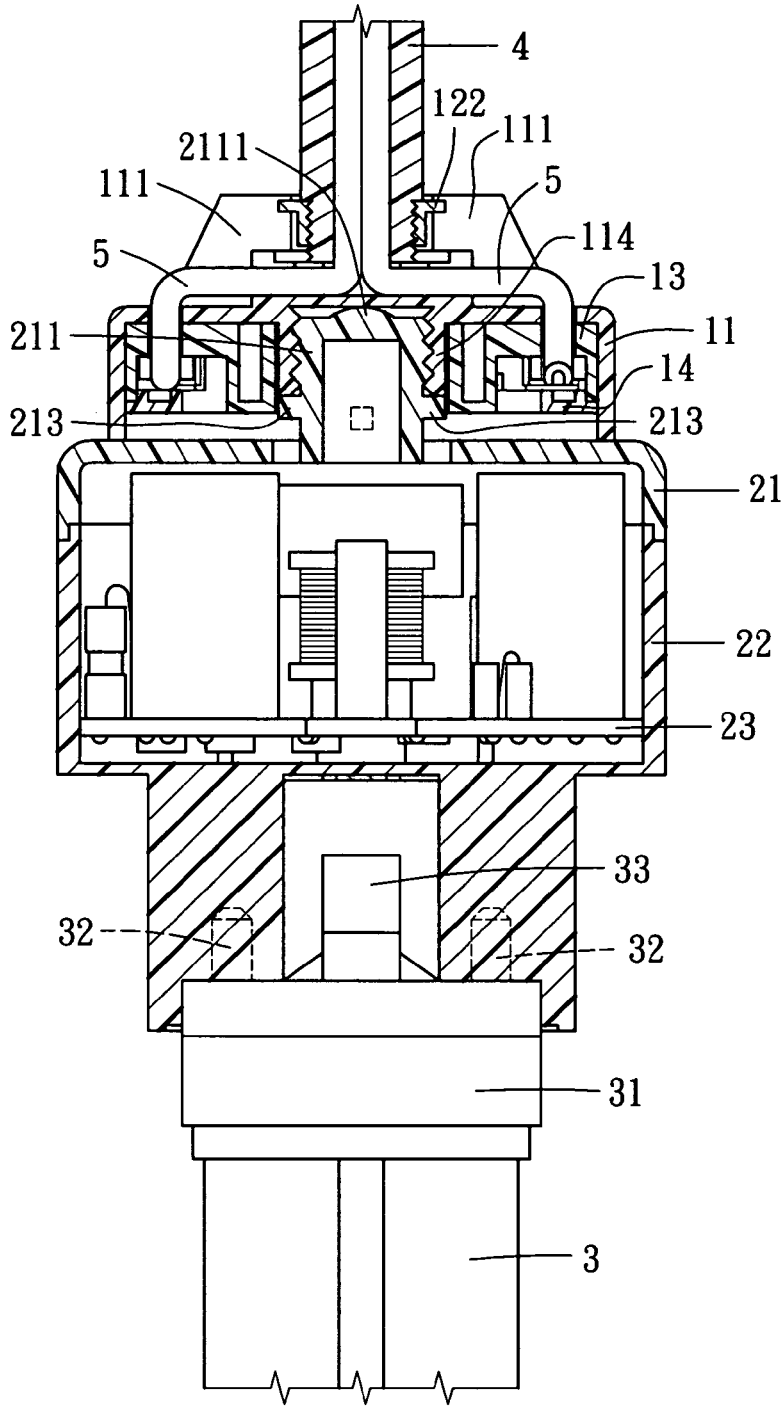
FIG. 12 is a cross-sectional view of the line C—C in FIG. 10.

In assembling, after the fundamental base 10 is integrally assembled, the wire tube 4 is fixedly installed at a definite location and the electrical wires 5 are disposed and connected with an electric source, electric current will be transmitted to the conducting members 139 to be connected. After the holder body 20 is integrally assembled, a CFL 3 can be fitted on the holder body 20 anytime. At this time, since the holder body 20 and the fundamental base 10 are separated from each other; therefore, the holder body 20 can be held with one hand and the CFL 3 can be conveniently installed on the holder body 20, so a user is needless to stand at a high location for carrying out installing work. After the CFL 3 is installed on the holder body 20, hold the outer wall of the holder body 20 with a hand and make its center threaded post 211 aligned to the female threaded post 114 at the underside of the fundamental base 10 and then threadably combine them together. At this time, the conducting posts 215 extending out of the topside of the holder body 20 are received in the annular passageway 147 of the bottom base 14 and moved therein. When the holder body 20 is threadably combined with the fundamental base 10, as shown in FIGS. 11 and 12, the positioning projections 212 of the upper cover 21, by action of material elasticity, will forcefully be turned to go over the hindrance of the projecting posts 115 of the base body 11 and reach to the lower edge of the female threaded post 114 of the base body 11, and the two resisting projections 213 of the upper cover 21 will respectively resist the two slanting walls 1141 of the female threaded post 114. Simultaneously, the semi-spherical projection 2111 on the topside of the center threaded post 211 of the upper cover 21 will push against the inner upper edge of the female threaded post 114 of the base body 11 to form a reactive pushing force for securing close engagement of the threads of the center male-threaded post 211 and the female thread post 114. In the meantime, the two conducting posts 215 of the upper cover 21 will respectively contact with the waveform conducting portion 1392 of the two conducting members 139. Therefore, as soon as the holder body 20 is threadably assembled with the fundamental base 10, the electric current will be transmitted to the two conducting posts 215 and then transmitted to the clamping members 24 and the CFL 3 through the circuit board 23 to start the CFL 3 to give out light instantly.

To remove the CFL 3 from the holder body 20 for repairing or replacing, only manually turn the holder body 20 reversely to disconnect its conducting posts 215 of the upper cover 21 from the conducting portions 1392 of the conducting members 139 to interrupt electric current. Subsequently, the holder body 20 together with the CFL 3 is turned reversely and removed from the fundamental base 10 and thus the CFL 3 can be easily pulled off the holder body 20. After the old CFL 3 is replaced, a new CFL 3 can be conveniently installed on the holder body 20 by repeating the process mentioned above.

As can be understood from the above description, the CFLH in the present invention is composed of the fundamental base 10 and the holder body 20 threadably combined together; therefore, they can be easily separated from each other for facilitating replacement of the CFL or repairing, original in structure and convenient in use.

While the preferred embodiment of the invention has been described above, it will be recognized and understood that various modifications may be made therein and the appended claims are intended to cover all such modifications that may fall within the spirit and scope of the invention.

I claim:

1. A compact fluorescent lampholder (CFLH) comprising a fundamental base and a holder body, said fundamental base having its underside fixed with a female threaded post, said fundamental base having two conducting members respectively positioned at the opposite sides of said female threaded post, said two conducting members of said fundamental base receiving electric current, said holder body provided on the topside with a center male-threaded post, said center male-threaded post threadably combined with said female threaded post of said fundamental base, said holder body having two conducting posts respectively positioned at the opposite sides of said center male-threaded post, said two conducting posts respectively contacting with said two conducting members of said fundamental base for receiving electric current after said center male-threaded post of said holder body is threadably combined with said female threaded post of said fundamental base, electric current transmitted to a circuit board installed in the interior of said holder body by said two conducting posts and then transmitted to the conducting posts of a compact fluorescent lamp (CFL) assembled under said holder body to start said CFL to give out light, said holder body and said fundamental base able to be separated from each other when said center threaded post of said holder body is turned reversely and disengaged from said female threaded post of said fundamental base, electric current between said conducting posts of said holder body and said conducting members and said fundamental base cut off when said socket body and said fundamental base is separated.

2. The compact fluorescent lampholder as claimed in claim 1, wherein said fundamental base is composed of a base body, a combining member, an inner cover and a bottom cover, said combining member combined on the topside of said base body, said combining member formed with a female threaded ring in the center, said female threaded ring threadably combined with the lower end of a wire tube, said wire tube fitted therein with electric wires, said electric wires extending out of said wire tube and passing through said female threaded ring to be inserted through the bottom of said base body, said base body having its underside provided with said female threaded post in the center and two symmetrical projecting posts on the outer circumferential edge of said female threaded post, said inner cover completely embedded in the underside of said base body, said inner cover formed with an insert hole in the center for said female threaded post of said base body to be inserted therethrough, said inner cover further bored with two symmetrical post holes for said two projecting posts of said base body to be respectively inserted and positioned therein, said inner cover having its underside formed with a plurality of symmetrical positioning projections for the ends of two curved conducting members to be respectively hooked thereon, said two conducting members connected with said electric wires, said bottom cover covered on the underside of said inner cover, said bottom cover, said inner cover and said base body combined together by means of bolts.

3. The compact fluorescent lampholder as claimed in claim 1, wherein said holder body is composed of an upper cover, a main body, said circuit board, plural clamping members and a lamp clamp, said upper cover having its topside provided with a center threaded post extending upward and two symmetrical conducting posts, said main body having its lower portion formed with a hollow cavity facing downward, said circuit board received in said hollow cavity of said main body, said hollow accommodating cavity having its lower side formed with a plurality of accommodating holes for respectively receiving said clamping members therein, said circuit board having a plurality of electronic elements inserted thereon, said electronic elements extending downward to be respectively connected with said clamping members, said electronic elements having their upper ends respectively connected with said conducting posts of said upper cover, the circumferential edges of said upper cover and said main body firmly combined together, said clamping members having their lower ends respectively located in the interiors of the small insert holes bored at the opposite sides of an insert groove provided for receiving a base of a CFL, said lower ends of said clamping members positioned in said small insert holes and contacting with the conducting posts of said pin lamp, said lamp clamp received in said insert groove for clamping said base of said CFL.

4. The compact fluorescent lampholder as claimed in claim 2, wherein said female threaded post of said base body of said fundamental base has its lower edge formed with two symmetrical slanting walls.

5. The compact fluorescent lampholder as claimed in claim 3, wherein said upper cover of said holder body has the upper end of said center male-threaded post formed with a semi-spherical projection and near the lower end of said center threaded post are provided with two pairs of symmetrical positioning projections, one pair of said symmetrical positioning projections positioned lower but longer than the other pair of said symmetrical positioning projections, in the process of threadably combining said center male-threaded post with said female threaded post said two longer positioning projections going over the hindrance of said projecting posts of said base body and reaching to the lower edge of said female threaded post, simultaneously said two shorter positioning projections resisting said two slanting walls at the lower edge of said female threaded post, meanwhile said semi-spherical projection of said center threaded post of said upper cover pushing against the inner upper edge of said female thread post of said base body.

* * * * *